US008434335B2

(12) United States Patent
Roth et al.

(10) Patent No.: US 8,434,335 B2
(45) Date of Patent: May 7, 2013

(54) COMBINATION DOOR LATCH AND DEADBOLT ASSEMBLY

(75) Inventors: Brian K. Roth, Elbert, CO (US); John B. Harris, Manitou Springs, CO (US)

(73) Assignee: Schlage Lock Company, Carmel, IN (US)

( * ) Notice: Subject to any disclaimer, the term of this patent is extended or adjusted under 35 U.S.C. 154(b) by 408 days.

(21) Appl. No.: 12/824,294

(22) Filed: Jun. 28, 2010

(65) Prior Publication Data

US 2011/0314878 A1 Dec. 29, 2011

(51) Int. Cl.
*E05B 59/00* (2006.01)

(52) U.S. Cl.
USPC ..... 70/107; 70/451; 70/461; 70/462; 292/DIG. 60; 292/34; 292/244

(58) Field of Classification Search ..... 70/107–109, 70/451, 461, 462; 292/34, 37, 244, DIG. 60
See application file for complete search history.

(56) References Cited

U.S. PATENT DOCUMENTS

| | | | |
|---|---|---|---|
| 3,999,789 | A | 12/1976 | Maurits et al. |
| 4,129,019 | A | 12/1978 | Urdal |
| 4,183,563 | A | 1/1980 | Stevens |
| 4,276,760 | A | 7/1981 | Nolin |
| 4,418,552 | A | 12/1983 | Nolin |
| 4,725,085 | A | 2/1988 | Hu et al. |
| 4,838,053 | A | 6/1989 | Shen |
| 5,077,992 | A | 1/1992 | Su |
| 5,496,082 | A | 3/1996 | Zuckerman |
| 5,513,505 | A | 5/1996 | Dancs |
| 5,544,507 | A | 8/1996 | Lin |
| 5,657,653 | A | 8/1997 | Hensley et al. |
| 5,713,612 | A | 2/1998 | Kajuch |
| 5,810,402 | A | 9/1998 | Armstrong |
| 5,881,586 | A | 3/1999 | Shen |
| 6,058,746 | A | 5/2000 | Mirshafiee et al. |
| 6,128,933 | A | 10/2000 | Mirshafiee et al. |
| 6,581,426 | B2 | 6/2003 | Bates et al. |
| 6,612,141 | B2 | 9/2003 | Bates et al. |
| 6,615,629 | B2 | 9/2003 | Bates et al. |
| 6,623,052 | B2 | 9/2003 | Hansen |
| 6,993,944 | B2 | 2/2006 | Hicks |
| 2005/0092040 | A1 | 5/2005 | Chuang |
| 2007/0040397 | A1 | 2/2007 | Nicholas, Jr. et al. |

FOREIGN PATENT DOCUMENTS

| | | |
|---|---|---|
| FR | 2753225 | 3/1998 |
| GB | 2211882 | 7/1989 |
| JP | 10148046 | 6/1998 |
| WO | 2007/120794 | 10/2007 |

*Primary Examiner* — Suzanne Barrett
(74) *Attorney, Agent, or Firm* — Michael Best & Friedrich LLP

(57) ABSTRACT

A combination door latch and deadbolt assembly that has first and second configurations for use with a door having a deadbolt aperture and a latchbolt aperture spaced by either a first vertical distance or a second vertical distance. The second vertical distance is less than the first vertical distance. In the first configuration, an insert slide is connected to an interconnect slide for vertical movement with the interconnect slide and the interconnect slide is operably connected to a deadbolt assembly via the insert slide. The insert slide and interconnect slide are movable vertically to move a deadbolt from an extended position to a retracted position in response to movement of an interior actuator from a first position to a second position. In the second configuration, the interconnect slide is operably connected to the deadbolt assembly without the insert slide.

23 Claims, 7 Drawing Sheets

COMBINATION DOOR LATCH AND DEADBOLT ASSEMBLY

BACKGROUND

The present invention relates to door locks, and more particularly, to a combination door latch and deadbolt assembly.

Door latches often include an interior actuator, an exterior actuator, and a latchbolt. The interior actuator and the exterior actuator both typically include a handle that a user can rotate or press to move the latchbolt to a retracted position in order to open the door. In addition, such a latch can be used with a deadbolt assembly. Deadbolt assemblies often include an interior actuator, such as thumb turn, and an exterior actuator, such as a lock cylinder that receives a key. The interior and exterior actuators of the deadbolt assembly are typically operable by the user to move the deadbolt back and forth between extended and retracted or locked and unlocked positions. In one type of door latch, often referred to as an interconnected lockset, the interior latchbolt actuator is interconnected with the deadbolt assembly so that operation of the interior latchbolt actuator to retract the latchbolt also retracts the deadbolt. Therefore, the user can exit the door without having to separately unlock or retract the deadbolt using the interior deadbolt actuator.

SUMMARY

In one embodiment, the invention provides a combination door latch and deadbolt assembly for use with a door having a deadbolt aperture and a latchbolt aperture that extend through the door, and the latchbolt aperture is spaced from the deadbolt aperture by a vertical distance. The assembly includes a deadbolt assembly having a deadbolt movable between an extended position and a retracted position, a latchbolt assembly having a latchbolt movable between an extended position and a retracted position, and an interior assembly including an actuator manually movable from a first position to a second position to move the latchbolt from the extended position to the retracted position. The assembly further includes an interconnect slide and an insert slide. The combination door latch and deadbolt assembly has first and second configurations. The first configuration is used when the door has the latchbolt aperture spaced from the deadbolt aperture by a first vertical distance and the second configuration is used when the door has the latchbolt aperture spaced from the deadbolt aperture by a second vertical distance that is less than the first vertical distance. In the first configuration, the insert slide is connected to the interconnect slide for vertical movement with the interconnect slide and the interconnect slide is operably connected to the deadbolt assembly via the insert slide. The interconnect slide and the insert slide are movable vertically from a first position to a second position to move the deadbolt from the extended position to the refracted position in response to movement of the actuator from the first position to the second position. In the second configuration, the interconnect slide is operably connected to the deadbolt assembly without the insert slide, and the interconnect slide is movable vertically from a first position to a second position to move the deadbolt from the extended position to the refracted position in response to movement of the actuator from the first position to the second position.

In another embodiment the invention provides a combination door latch and deadbolt assembly for use with a door having a deadbolt aperture and a latchbolt aperture that extend through the door, and the latchbolt aperture is spaced from the deadbolt aperture by a vertical distance. The assembly includes a deadbolt assembly having a deadbolt movable between an extended position and a retracted position, a latchbolt assembly having a latchbolt movable between an extended position and a retracted position, and an interior assembly having an actuator manually movable from a first position to a second position to move the latchbolt from the extended position to the retracted position. The assembly further includes a thumb turn actuator manually operable to move the deadbolt between the refracted position and the extended position, and an interior escutcheon including an elongated thumb turn aperture for the thumb turn actuator. The combination door latch and deadbolt assembly has first and second configurations. The first configuration is used when the door has the latchbolt aperture spaced from the deadbolt aperture by a first vertical distance and the second configuration is used when the door has the latchbolt aperture spaced from the deadbolt aperture by a second vertical distance that is less than the first vertical distance. The elongated thumb turn aperture has a length sufficient to permit the thumb turn actuator to extend through the thumb turn aperture when the thumb turn actuator is located at a first vertical position in response to the assembly being configured for use in the first configuration and to permit the thumb turn actuator to extend through the thumb turn aperture when the thumb turn actuator is located at a second vertical position in response to the assembly being configured for use in the second configuration.

In another embodiment the invention provides a combination door latch and deadbolt assembly for use with a door having a deadbolt aperture and a latchbolt aperture that extend through the door and the latchbolt aperture is spaced from the deadbolt aperture by a vertical distance. The assembly includes a deadbolt assembly including a deadbolt movable between an extended position and a retracted position, a latchbolt assembly including a latchbolt movable between an extended position and a retracted position, an interior actuator manually movable from a first position to a second position to move the latchbolt from the extended position to the retracted position, and an interconnect slide movable vertically to move the deadbolt from the extended position to the refracted position in response to movement of the interior actuator from the first position to the second position. The assembly further includes a base plate configured to be coupled to the door and the interconnect slide is coupled to the base plate such that the base plate guides vertical movement of the interconnect slide. The combination door latch and deadbolt assembly has first and second configurations. The first configuration is used when the door has the latchbolt aperture spaced from the deadbolt aperture by a first vertical distance, and the second configuration is used when the door has the latchbolt aperture spaced from the deadbolt aperture by a second vertical distance less than the first vertical distance. The interior actuator is in a first fixed position relative to the base plate when the assembly is in the first configuration, and the interior actuator is in a second fixed position relative to the base plate vertically spaced from the first fixed position when the assembly is in the second configuration.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
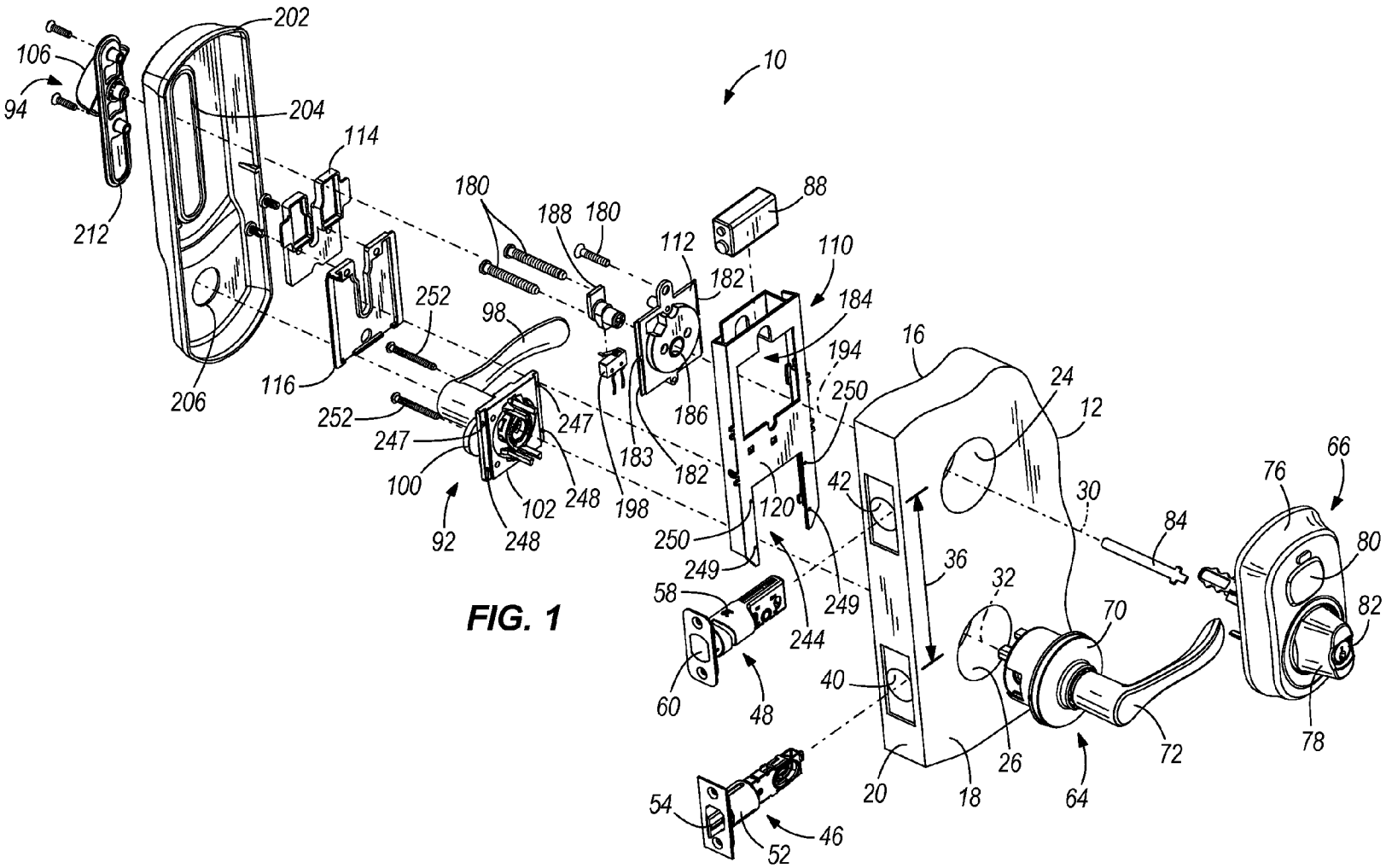
FIG. 1 is a partially exploded view of a combination door latch and deadbolt assembly according to one embodiment of the invention.

FIG. 1 illustrates a combination door latch and deadbolt assembly 10 for use with a door 12. The illustrated combination door latch and deadbolt assembly 10 of FIG. 1 is also referred to as an interconnected lockset. The door 12 includes an interior side 16, an exterior side 18, and an edge 20 between sides 16 and 18. A deadbolt aperture 24 and a latchbolt aperture 26 extend through the door 12 from the interior side 16 to the exterior side 18. The deadbolt aperture 24 and the latchbolt aperture 26 include centerlines 30 and 32, respectively, that are spaced a vertical distance 36. As will be discussed in more detail below, the combination door latch and deadbolt assembly 10 can be configured for use with doors having the deadbolt aperture 24 and the latchbolt aperture 26 spaced at different vertical distances 36. The door 12 further includes a latchbolt bore 40 and a deadbolt bore 42. The bores 40 and 42 extend from the edge 20 of the door 12 and into the latchbolt aperture 26 and the deadbolt aperture 24, respectively.

With continued reference to FIG. 1, the combination door latch and deadbolt assembly 10 further includes a latchbolt assembly 46 and a deadbolt assembly 48. The latchbolt assembly 46 includes a housing 52 and a latchbolt 54. The housing 52 is received within the latchbolt bore 40 to couple the latchbolt assembly 46 to the door 12, and the latchbolt 54 is movable with respect to the housing 52 between an extended position (illustrated in FIG. 1) and a retracted position as is well understood in the art. The deadbolt assembly 48 includes a housing 58 and a deadbolt 60. The housing 58 of the deadbolt assembly 48 is received within the deadbolt bore 42 to couple the assembly 48 to the door 12, and the deadbolt 60 is movable with respect to the housing 58 between an extended position (FIG. 3) and a retracted position (FIG. 1) as is well understood in the art.

Figure 2:
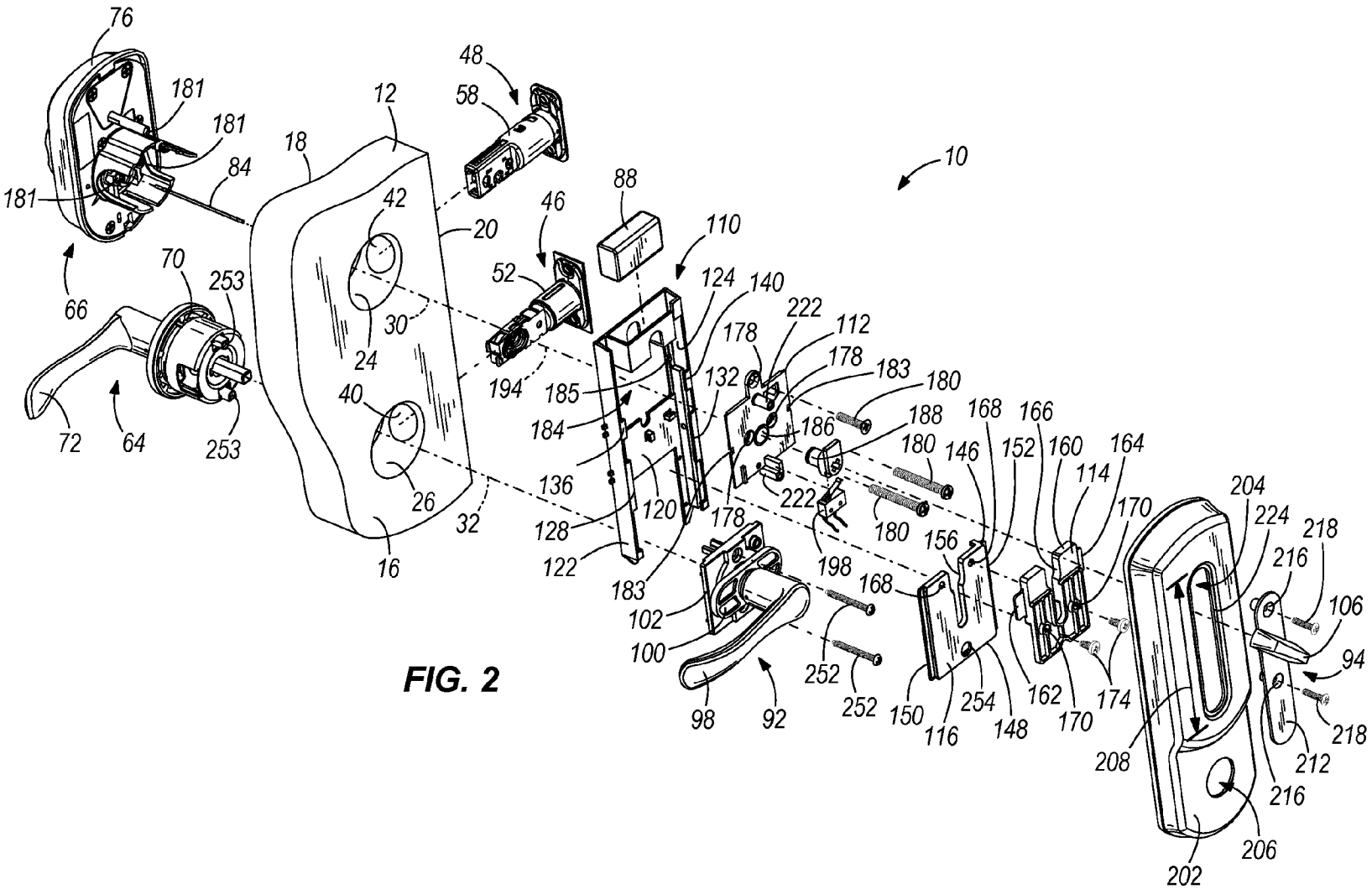
FIG. 2 is an alternative exploded view of the assembly of FIG. 1.

Referring to FIGS. 1 and 2, the assembly 10 further includes an exterior latchbolt operator 64 and an exterior deadbolt operator 66. The exterior latchbolt operator 64 includes a housing 70 and an actuator 72 that is manually movable with respect to the housing 70 to move the latchbolt 54 from the extended position to the retracted position. The illustrated actuator 72 is a lever that rotates with respect to the housing 70, but in other constructions, the actuator 72 can be any suitable actuator, such as a knob, a handleset actuator, other types of levers, and the like. The housing 70 is partially received within the latchbolt aperture 26 of the door 12 to couple the exterior latchbolt operator 64 to the door 12.

The exterior deadbolt operator 66 is operable to move the deadbolt 60 between the retracted and the extended positions, and the illustrated operator 66 includes a housing 76, a first actuator 78, and a second actuator 80. The housing 76 of the exterior deadbolt operator 66 is coupled to the door 12 such that operator 66 is partially received within the deadbolt aperture 24 of the door 12. In the illustrated construction, the first actuator 78 includes a lock cylinder 82 configured to receive a key. As well understood in the art, the key and lock cylinder 82 are operable by the user to rotate a driver 84, and rotation of the driver 84 moves the deadbolt 60 between the retracted and extended positions. The second actuator 80 is an electronic actuator that is configured to read a magnetic card or the like, and the actuator 80 uses a battery 88 to rotate the driver 84 to move the deadbolt 60 from the extended position to the retracted position. While the illustrated exterior deadbolt operator 66 includes two actuators 78 and 80, in other constructions, the operator 66 may include only one of the actuators 78 or 80, and in yet other constructions, other suitable types of exterior deadbolt actuators may be used. For example, in one construction, the exterior deadbolt operator can include the exterior deadbolt operator described in U.S. Patent Application Publication No. 2009/0133454, the entire contents of which are hereby incorporated by reference herein.

Figure 3:
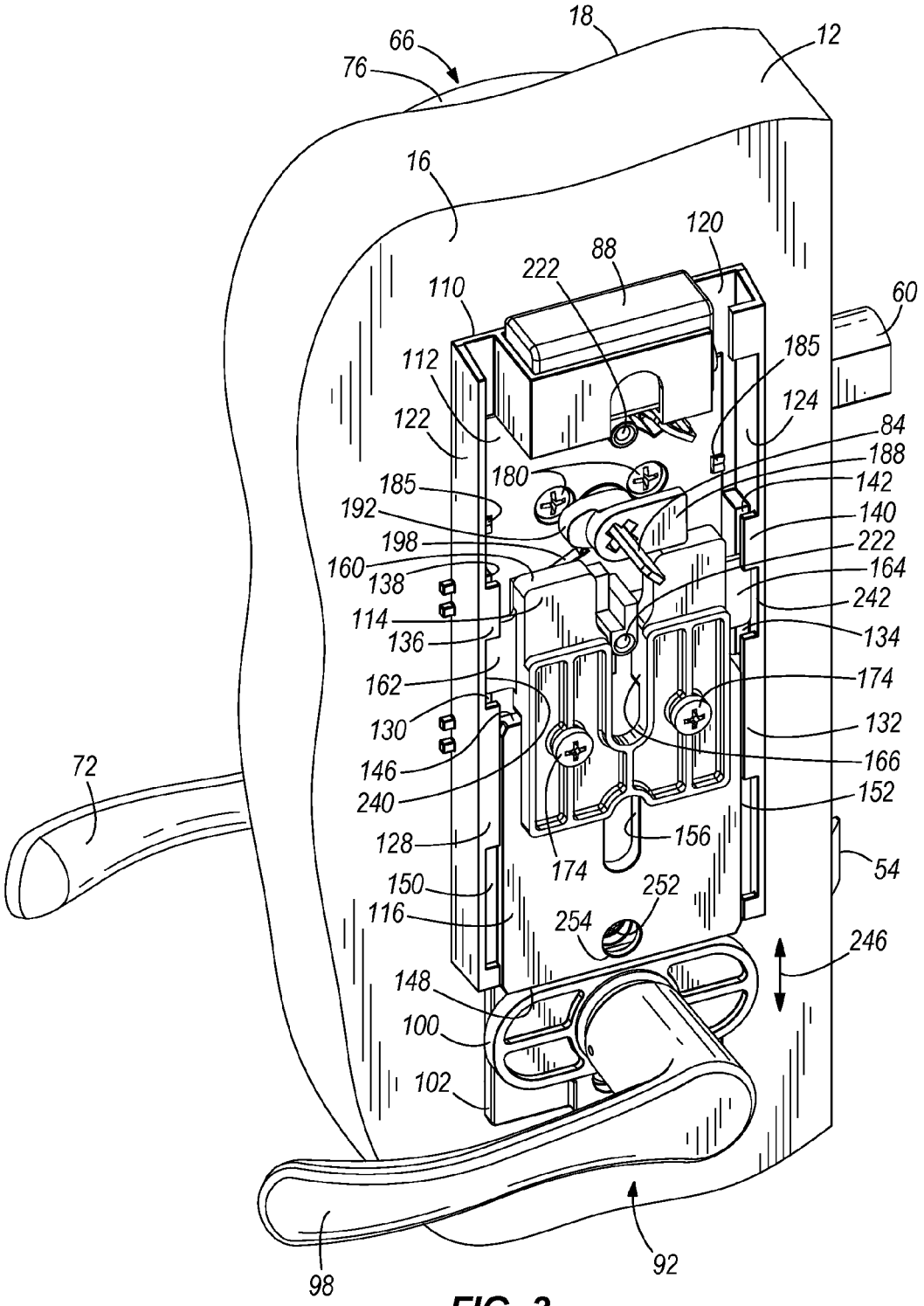
FIG. 3 is an assembled view of the assembly of FIG. 1 from the interior, configured for use in a first configuration, and with an interior escutcheon removed.
Figure 4:
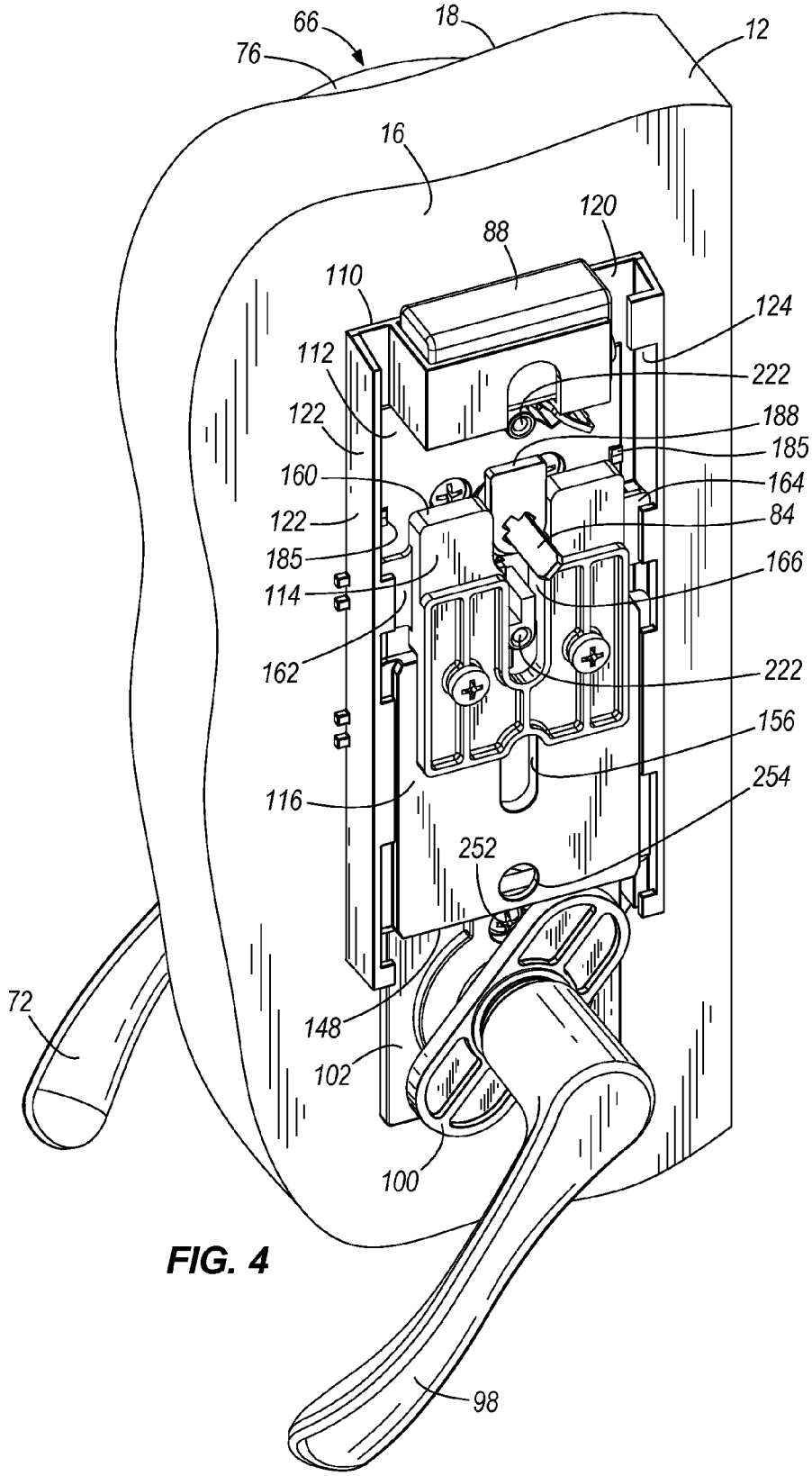
FIG. 4 is a view similar to FIG. 3 illustrating operation of assembly.
Figure 5:
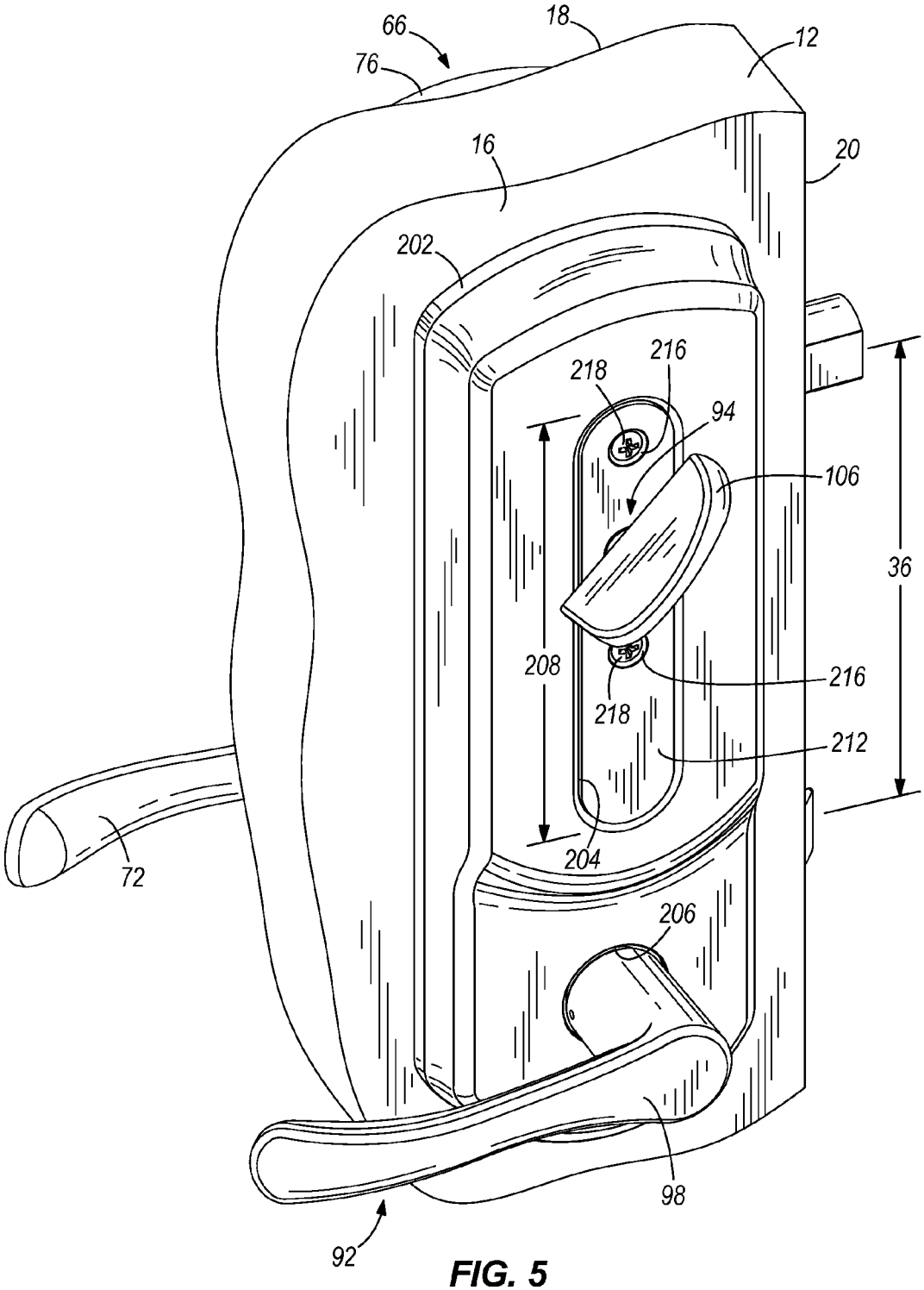
FIG. 5 is a view similar to FIG. 3 including the interior escutcheon.

The door latch and deadbolt assembly 10 can be used with doors having the latchbolt aperture 26 spaced from the deadbolt aperture 24 by different distances. FIGS. 3-5 illustrate the door latch and deadbolt assembly 10 in a first configuration configured for use with the door 12 having the latchbolt aperture 26 spaced from the deadbolt aperture 24 by a first vertical distance 36 (FIG. 1). In one construction, the first vertical distance 36 can be 5.5 inches which is a common distance for many doors. If the latchbolt aperture 26 is spaced from the deadbolt aperture 24 by a second vertical distance 236 (FIG. 6) that is less than the first vertical distance 36 (FIG. 1), the user can place the assembly in a second configuration. In one construction, the second vertical distance 236 can be four inches which is another common distance for many doors. In other constructions, the first vertical distance 36 and the second vertical distance 236 can be other suitable distances besides 5.5 inches and four inches, respectively.

With continued reference to FIGS. 1 and 2, the assembly 10 further includes an interior latchbolt operator assembly 92 and an interior deadbolt operator 94. The illustrated door latch and deadbolt assembly 10 is an interconnected lock. Therefore, the interior latchbolt operator 92 is operable to retract both the latchbolt 54 and the deadbolt 60, which will be discussed in more detail below. The interior assembly 92 includes an actuator 98, an interconnect slide cam member 100, and a latchbolt actuator or bottom plate 102. As will be discussed in more detail below, the actuator 98 is operable to rotate the cam member 100, which retracts the deadbolt 60, and the bottom plate 102 is used to position the interior latchbolt operator assembly 92 depending on the distance 36 or 236 between the latchbolt aperture 26 and the deadbolt aperture 24. In the illustrated construction, the actuator 98 is a rotating lever, but in other constructions, the actuator can be any suitable actuator, such as a knob, a handleset actuator, and the like.

The illustrated interior deadbolt operator 94 includes a thumb turn 106 that is coupled to the driver 84. As is well understood in the art, the thumb turn 106 is coupled to the driver 84 and the driver 84 is coupled to the deadbolt assembly 48 such that rotation of the thumb turn 106 by the user moves the deadbolt 60 between the retracted and extended positions.

The assembly 10 further includes a base or top plate 110, a deadbolt actuator or thumb turn plate 112, an insert slide 114, and an interconnect slide 116. The top plate 110 guides movement of the slides 114 and 116, and the slides 114 and 116 move with respect to the top plate 110 in response to rotation of the actuator 98 and the cam member 100 of the latchbolt operator assembly 92 to retract the deadbolt 60. As best seen in FIG. 3, the top plate 110 includes a base 120, a first side wall 122 that extends upwardly from the base, generally normal to the base 120 along a first side of the base 120, and a second side wall 124 that extends upwardly from the base 120, generally normal to the base 120 along an second side of the base 120 opposite the first side wall 122. A first tab 128 extends from the first side wall 122 to define a first slot 130 between the first tab 128 and the base 120. A second tab 132 extends from the second side wall 124 to define a second slot 134 between the second tab 132 and the base 120. A third tab 136 extends from the first side wall 122 to define a third slot 138 between the third tab 136 and the base 120. A fourth tab 140 extends from the second side wall 124 to define a fourth slot 142 between the fourth tab 140 and the base 120.

Referring to FIGS. 2 and 3, the interconnect slide 116 includes a top edge 146, a bottom edge 148, a first side edge 150, and a second side edge 152. A generally U-shaped recess 156 is formed in the interconnect slide 116 with an opening in the top edge 146. The interconnect slide 116 is coupled to the top plate 110 such that the edges 150 and 152 of the slide 116 are received within the slots 130 and 134, respectively. The slide 116 is configured to slide vertically or up and down with respect to the top plate 110, and the slots 130 and 134 guide movement of the slide 116 in the vertical direction.

The insert slide 114 includes a top edge 160, a first side wing 162, and a second side wing 164. A generally U-shaped recess 166 is formed in the insert slide 114 with an opening in the top edge 160. The insert slide 114 is coupled to the top plate 110 such that the side wings 162 and 164 are received within the slots 138 and 142, respectively. The insert slide 114 is configured to slide vertically or up and down with respect to the top plate 110, and the slots 138 and 142 guide movement of the insert slide 114 in the vertical direction.

With continued reference to FIGS. 2 and 3, the interconnect slide 116 includes a pair of apertures 168 and the insert slide 114 includes a pair of apertures 170. Each of the apertures 168 is aligned with a respective aperture 170. Each pair of aligned apertures 168 and 170 is configured to receive a respective fastener 174 to removably couple the interconnect slide 116 and the insert slide 114. In the illustrated construction, the fasteners 174 are threaded screws, but in other constructions, other types of fasteners can be used.

Referring to FIGS. 2 and 3, the thumb turn plate 112 couples the top plate 110 to the interior side 16 of the door so that the top plate 110 and the thumb turn plate 112 are fixed with respect to the door 12. The thumb turn plate 112 includes apertures 178 that receive respective fasteners 180, which are threaded screws in the illustrated construction. The fasteners 180 each extend through the respective aperture 178, through the deadbolt aperture 24, and into a respective threaded post 181 of the exterior deadbolt operator 66. The thumb turn plate 112 further includes tabs 182 (FIG. 1) that extend along opposite sides of the plate 112 and notches 183 (FIG. 2) that extend through the tabs 182. The top plate 110 includes an opening 184 and posts 185 that are located on opposite sides of the opening 184. The thumb turn plate 112 is received within the opening 184 of the top plate 110 such that the notches 183 of the thumb turn plate 112 receive the posts 185 of the top plate 110 and the tabs 182 of the thumb turn plate 112 contact the top plate 110. In one construction, the thumb turn plate 112 is welded to the top plate 110 and the posts 185 facilitate forming the welded connection between the plates 110 and 112. The fasteners 180 are tightened into the threaded posts 181 to couple the top plate 110 to the door 12 and fix the position of the top plate 110 with respect to the door 12. A central aperture 186 extends through the thumb turn plate 112, and the driver 84 extends through the central aperture 186 of the thumb turn plate 112 when the assembly 10 is assembled (FIG. 3). In one construction, the thumb turn plate 112 is made from a first material, such as steel, and the top plate 110 is made from a second material, such as zinc. Then, the plates 110 and 112 are coupled together, such as by welding as discussed above. Forming the thumb turn plate 112 from steel provides additional strength to the assembly 10 while allowing the top plate 110 to be formed relatively easily from zinc. In other constructions, the thumb turn plate 112 can be integrally formed as a single component with the top plate 110 from the same material.

Referring to FIG. 3, the assembly 10 further includes a deadbolt cam member 188 having a lobe 192. The cam member 188 is coupled to the driver 84 so that the cam member 188 rotates with the driver 84 about axis 194 (FIG. 1). The lobe 192 engages a micro-switch 198 to electronically indicate whether the deadbolt 60 is in the retracted or extended position based on the position of the driver 84, and therefore, cam member 188 or lobe 192.

Referring to FIGS. 2 and 5, the assembly 10 further includes an interior escutcheon 202 that can be coupled to the thumb turn plate 112. The escutcheon 202 includes an upper aperture 204 and a lower aperture 206. The interior latchbolt actuator 98 extends through the lower aperture 206. The upper aperture 204 is elongated and has a length 208. The upper aperture 204 is configured to receive a thumb turn aperture cover plate 212 that covers the aperture 204. The cover plate 212 includes apertures 216 that receive respective fasteners 218. Each fastener 218 extends through the respective aperture 216 and into a respective threaded post 222 of the thumb turn plate 112. The escutcheon 202 includes a recess 224 that extends around the upper aperture 204. When the fasteners 218 are tightened into posts 222, the cover plate 212 presses against the escutcheon 202 within the recess 224 to couple the escutcheon 202 and the plate 212 to the thumb turn plate 112.

In operation, referring to FIG. 3, when the deadbolt 60 is in the extended or locked position and the interior actuator 98 is in a first position so that the latchbolt 54 is in the extended position, the assembly 10 is in a locked state. In the locked state, the deadbolt cam member 188 is in a horizontal position and contacts the top edge 160 of the insert slide 114. Also, the bottom edge 148 of the interconnect slide 116 rests on the interconnect slide cam member 100. To exit the door 12 and unlock the assembly 10, the user can rotate the interior actuator 98 to a second position (FIG. 4). Rotating the interior actuator 98 causes the cam member 100 to also rotate and force the interconnect slide 116 to move up from the position illustrated in FIG. 3 to the position illustrated in FIG. 4. Upward movement of the slide 116 is guided by the top plate 110. Because the insert slide 114 is coupled to the interconnect slide 116, the insert slide 114 moves up with the interconnect slide 116. Upward movement of the insert slide 114 forces the deadbolt cam member 188 to rotate, which rotates the driver 84. The deadbolt cam member 188 rotates from the horizontal position illustrated in FIG. 3 to a vertical position illustrated in FIG. 4 where it is partially received within the recess 166 of the insert slide 114. Rotation of the cam member 188 from the horizontal position to the vertical position causes the driver 84 to rotate and move the deadbolt 60 from the extended position to the retracted position. Also, as discussed above, rotation of the interior actuator 98 also moves the latchbolt 54 from the extended position to the retracted position. Alternatively, the user can rotate the thumb turn 106 (FIG. 5) to directly move the deadbolt 60 between the extended and retracted positions as is well understood in the art.

With both the deadbolt 60 and the latchbolt 54 in the retracted positions, the user can open the door 12. When the door 12 closes, the latchbolt 54 returns to the extended position while the deadbolt 60 remains in the retracted position. After exiting, the user can use the exterior deadbolt operator 66 to move the deadbolt 60 back to the extended or locked position.

Figure 6:
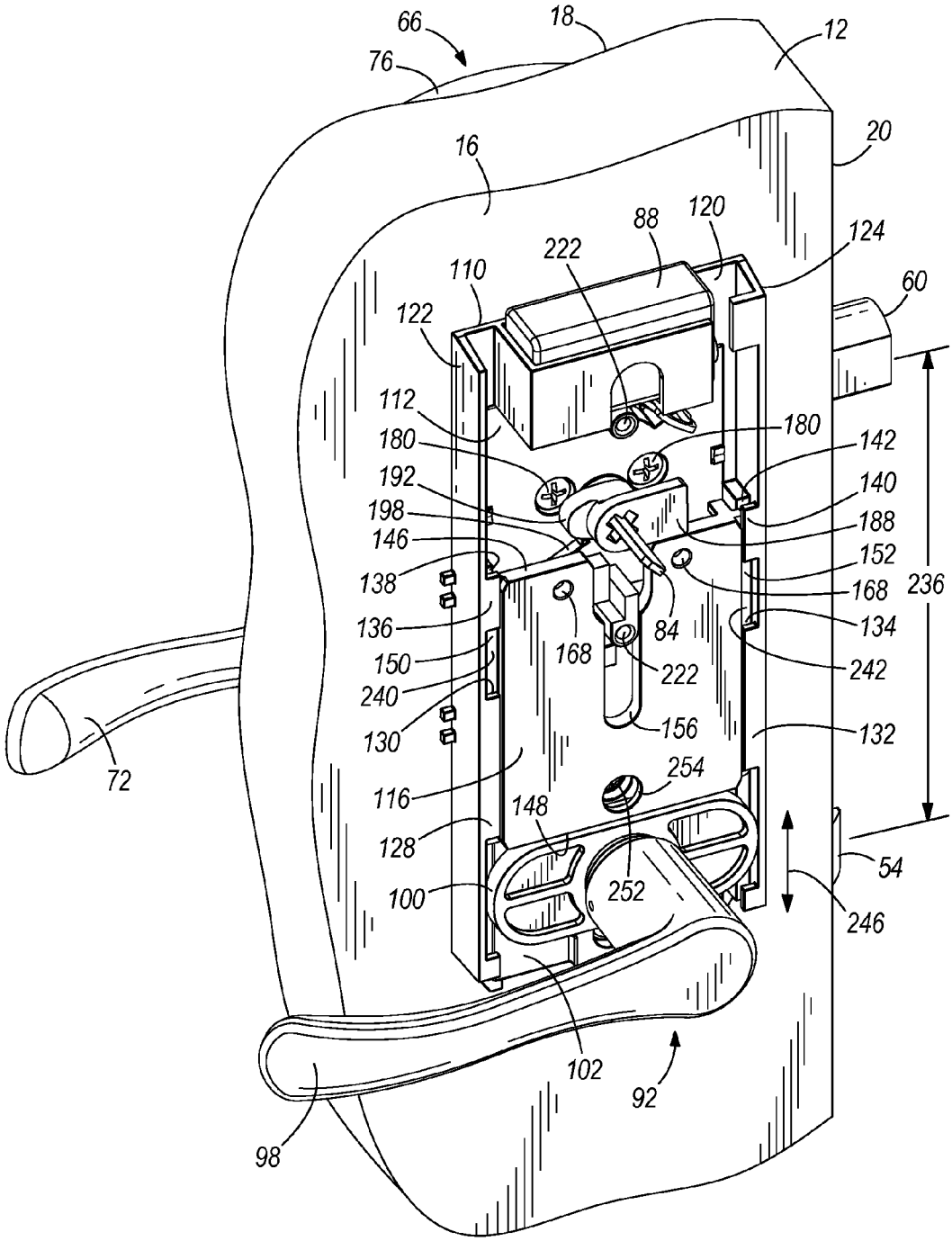
FIG. 6 is a view similar to FIG. 3 illustrating the assembly configured for use in a second configuration.

As discussed above, the door latch and deadbolt assembly can be used in the first configuration when the latchbolt aperture 26 is spaced from the deadbolt aperture 24 by the first distance 36 (FIG. 1) or in the second configuration when the apertures 24 and 26 are spaced by the second distance 236 (FIG. 6). To install the illustrated assembly 10 in the second configuration (FIG. 6), the user uncouples the insert slide 114 from the interconnect slide 116 and removes the insert slide 114 from the assembly 10. In the illustrated construction, to uncouple or disconnect the slides 114 and 116, the fasteners 174 (FIG. 3) are removed from the apertures 168 and 170. Then, the insert slide 114 is removed by pulling the wings 162 and 164 of the insert slide 114 through respective gaps 240 and 242 (FIG. 3). The gap 240 is formed between the first tab 128 and the third tab 136 and the gap 242 is formed between the second tab 132 and the fourth tab 140.

Then, referring to FIG. 6 the user moves the bottom plate 102 with respect to the top plate 110 up from a first or lower fixed position (FIG. 3) to a second or upper fixed position (FIG. 6). The top plate 110 includes an aperture or cutout 244 (FIG. 1) that allows the bottom plate 102 to move up and down with respect to the top plate 110. Moving the bottom plate 102 from the lower fixed position to the upper fixed position also causes the interior latchbolt actuator 98 and the interconnect slide cam member 100 to move up with the plate 102 with respect to the top plate 110. To move the bottom plate 102 between the upper and lower fixed positions, the user slides the plate 102 a vertical distance with respect to the top plate 110 in the direction of arrows 246. In the illustrated construction, the vertical distance that the user moves the bottom plate 102 is equal to the difference between the distances 36 and 236 between the deadbolt aperture 24 spaced from the latchbolt aperture 26. The side walls 122 and 124 guide movement of the plate 102 in the vertical direction (e.g., direction of arrows 246). The bottom plate 102 is positioned in the upper position (FIG. 6) so that the interconnect slide cam member 100 contacts the bottom edge 148 of the interconnect slide 116 and the top edge 146 of the interconnect slide 116 contacts the deadbolt cam member 188 when the deadbolt 60 is in the extended position (FIG. 6). As best seen in FIG. 1, the bottom plate 102 includes upper projections 247 and lower projections 248 and the top plate 110 includes lower recesses 249 and upper recesses 250. The recesses 249 and 250 and the projections 247 and 248 help the user locate the correct position of the bottom plate 102. For example, when the bottom plate 102 is in the lower position (FIG. 3), the upper projections 247 of the plate 102 are received in the lower recesses 249 of the top plate 110. When the bottom plate 102 is in the upper position (FIG. 6), the upper projections 247 are received in the upper recesses 250 and the lower projections 248 are received in the lower recesses 249. The position of the bottom plate 102 is fixed by inserting fasteners, which are two screw 252 in the illustrated construction, through the plate 102, through the latchbolt aperture 26, and into threaded posts 253 (FIG. 2) of the exterior latchbolt operator 64. An access hole 254 (FIG. 3) in the interconnect slide 116 facilitates installation of the upper screw 252.

Figure 7:
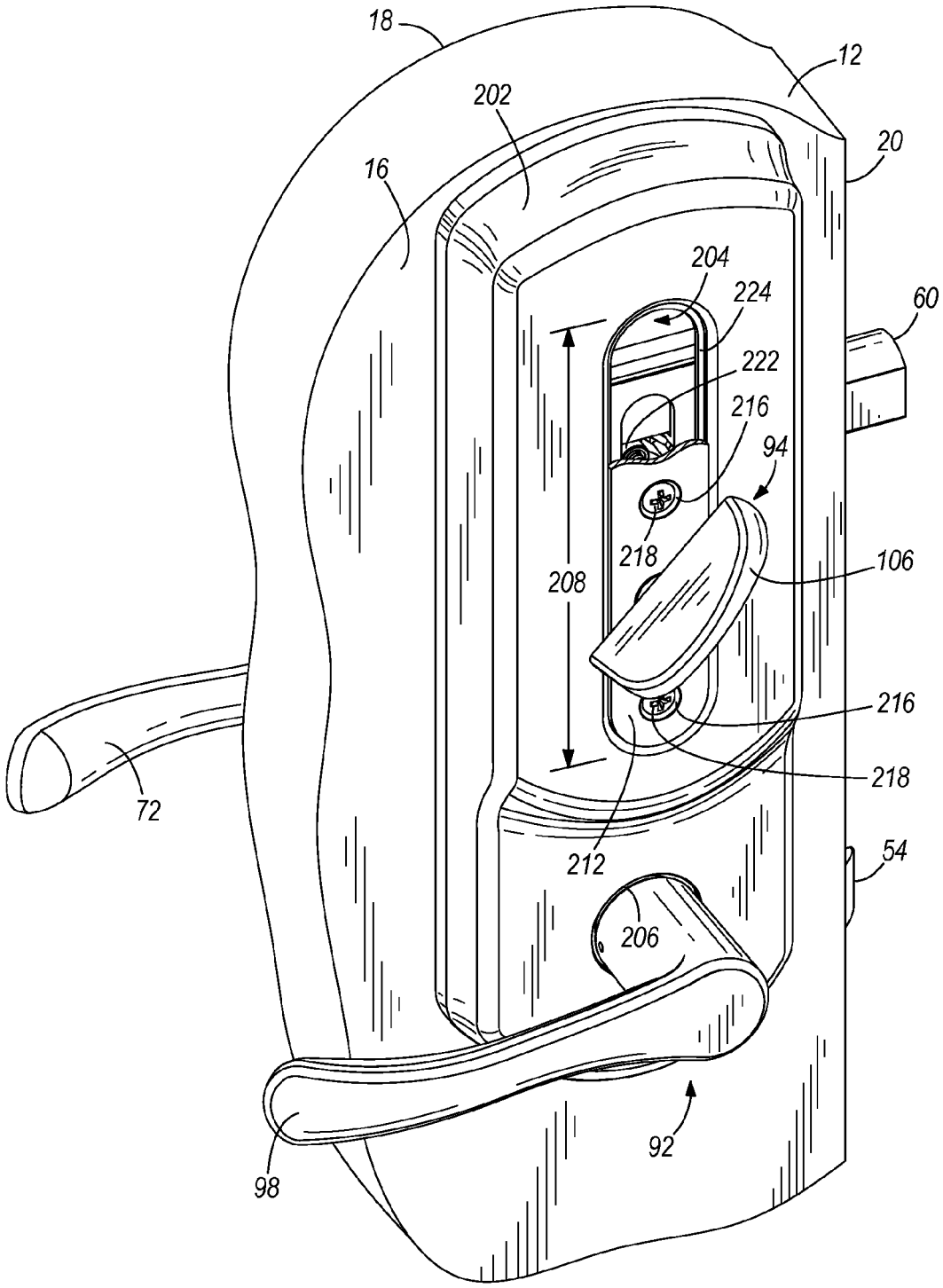
FIG. 7 is a view similar to FIG. 6 including the interior escutcheon and a portion of a cover plate of the escutcheon removed.

With the assembly 10 in the second configuration, as illustrated in FIG. 6, the interior escutcheon 202 is installed (FIG. 7). The upper aperture 204 of the escutcheon 202 has the length 208 that is sufficient to permit the thumb turn actuator 106 to extend through the aperture 204 when the assembly 10 is in either the first or the second configuration. Alternatively stated, the length 208 of the aperture 204 long is enough so that the actuator 106 can extend through the aperture 204 when the thumb turn actuator 106 is located at a first vertical position with respect to the lever 98 (FIG. 5) or when the thumb turn actuator 106 is located at a second vertical position (FIG. 7) with respect to the lever 98 in response to the assembly 10 being in either the first or the second configuration. Accordingly, the same escutcheon 202 can be used in both the first and the second configurations of the assembly 10. Likewise, the same cover plate 212 can be used with the escutcheon 202 in both the first and the second configurations of the assembly 10. The illustrated cover plate 212 is rotated 180 degrees about the thumb turn 106 from the position illustrated in FIG. 5 to the position illustrated in FIG. 7 depending on whether the assembly 10 is in the first configuration (FIG. 5) or the second configuration (FIG. 7).

Accordingly, the combination door lock and deadbolt assembly 10 can be installed on the door 12 having the deadbolt aperture 24 spaced from the latchbolt aperture 26 by either the vertical distance 36 (FIG. 1) or the vertical distance 236 (FIG. 6). After determining the vertical distance 36 or 236, the user can configure the assembly 10 in either the first configuration (FIG. 3) or the second configuration (FIG. 6) by either removing or installing the insert slide 114 depending on the distance 36 or 236 and positioning the bottom plate 102 of the interior latchbolt assembly 92 as discussed above. Furthermore, the escutcheon 202 and cover plate 212 are configured so that the same escutcheon 202 and cover plate 212 can be used whether the assembly is used in either the first or the second configuration.

Various features and advantages of the invention are set forth in the following claims.

What is claimed is:

1. A combination door latch and deadbolt assembly for use with a door having a deadbolt aperture and a latchbolt aperture that extend through the door, the latchbolt aperture spaced from the deadbolt aperture by a vertical distance, the assembly comprising:

a deadbolt assembly including a deadbolt movable between an extended position and a retracted position;

a latchbolt assembly including a latchbolt movable between an extended position and a retracted position;

an interior assembly including an actuator manually movable from a first position to a second position to move the latchbolt from the extended position to the refracted position;

an interconnect slide; and an insert slide configured to be removably coupled to the interconnect slide;

the combination door latch and deadbolt assembly having first and second configurations, the first configuration being used when the door has the latchbolt aperture spaced from the deadbolt aperture by a first vertical distance, and the second configuration being used when the door has the latchbolt aperture spaced from the deadbolt aperture by a second vertical distance less than the first vertical distance, wherein, in the first configuration, the insert slide is connected to the interconnect slide for vertical movement with the interconnect slide and the interconnect slide is operably connected to the deadbolt assembly via the insert slide, the interconnect slide and the insert slide are movable vertically from a first position to a second position to move the deadbolt from the extended position to the refracted position in response to movement of the actuator from the first position to the second position, and wherein, in the second configuration, the insert slide is not connected to the interconnect slide for vertical movement with the interconnect slide and the interconnect slide is operably connected to the deadbolt assembly, and the interconnect slide is movable vertically from a first position to a second position to move the deadbolt from the extended position to the retracted position in response to movement of the actuator from the first position to the second position.

2. The combination door latch and deadbolt assembly of claim 1, wherein the deadbolt assembly includes, a driver rotatable to move the deadbolt from the extended position to the retracted position, and a deadbolt cam member coupled to the driver for rotation with the driver, wherein the interconnect slide directly engages the deadbolt cam member as the interconnect slide moves from the first position toward the second position when the assembly is in the second configuration to rotate the deadbolt cam member and the driver to move the deadbolt toward the refracted position, and wherein the insert slide directly engages the deadbolt cam member as the insert slide and interconnect slide move from the first position toward the second position when the assembly is in the first configuration to rotate the deadbolt cam member and the driver to move the deadbolt toward the retracted position.

3. The combination door latch and deadbolt assembly of claim 1, wherein the interior assembly includes an interconnect slide cam member coupled to the actuator and configured to rotate in response to movement of the actuator from the first position to the second position of the actuator, and wherein the interconnect slide cam member directly engages the interconnect slide to move the interconnect slide from the first position to the second position when the assembly is in the first configuration and the second configuration.

4. The combination door latch and deadbolt assembly of claim 1, further comprising:

a base plate configured to be coupled to the door, the base plate including a base, a first side wall that extends from the base, and a second side wall that extends from the base, wherein the interconnect slide is coupled to the base plate between the first side wall and the second side wall such that the interconnect slide slides with respect to the base plate between the first position and the second position and the first side wall and the second side wall of the base plate guide movement of the interconnect slide between the first position and the second position, and wherein the insert slide is coupled to the base plate when the assembly is in the first configuration such that the insert slide slides with respect to the base plate between the first position and the second position and the first side wall and the second side wall of the base plate guide movement of the insert slide between the first position and the second position.

5. The combination door latch and deadbolt assembly of claim 4, further comprising, a deadbolt actuator plate coupled to the base plate;

a driver that extends through the deadbolt actuator plate and the driver configured to rotate to move the deadbolt between the extended position and the retracted position, and wherein the base plate is made from a first material, and wherein the deadbolt actuator plate is made from a second material.

6. The combination door latch and deadbolt assembly of claim 4, wherein the base plate includes a first tab that extends from the first side wall to define a first slot between the first tab and the base and a second tab that extends from the second side wall to define a second slot between the second tab and the base, and wherein the first slot and the second slot guide movement of the interconnect slide between the first position and the second position.

7. The combination door latch and deadbolt assembly of claim 6, wherein the base plate includes a third tab that extends from the first side wall to define a third slot between the third tab and the base and a fourth tab that extends from the second side wall to define a fourth slot between the second tab and the base, and wherein the third slot and the fourth slot guide movement of the insert slide between the first position and the second position.

8. The combination door latch and deadbolt assembly of claim 4, wherein the interior assembly includes a latchbolt actuator plate, wherein the actuator of the interior assembly is coupled to the latchbolt actuator plate for movement with the latchbolt actuator plate with respect to the base plate, and wherein the latchbolt actuator plate is coupled to the base plate between the first side wall and the second side wall of the base plate such that the first side wall and the second side wall guide movement of the latchbolt actuator plate between a first fixed position when the assembly is in the first configuration and a second fixed position spaced vertically from the first fixed position when the assembly is in the second configuration.

9. The combination door latch and deadbolt assembly of claim 1, wherein the interconnect slide includes an aperture, wherein the insert slide includes an aperture, the assembly further comprising a fastener configured to be received within the aperture of the interconnect slide and the aperture of the insert slide to removably couple the insert slide and the interconnect slide.

10. The combination door latch and deadbolt assembly of claim 1, further comprising:

a thumb turn actuator manually operable to move the deadbolt between the retracted position and the extended position, an interior escutcheon including an elongated thumb turn aperture for the thumb turn actuator and an interior actuator aperture for the actuator of the interior assembly, and wherein the elongated thumb turn aperture has a length sufficient to permit the thumb turn actuator to extend through the thumb turn aperture when the thumb turn actuator is located at a first vertical position in response to the assembly being configured for use in the first configuration and to permit the thumb turn actuator to extend through the thumb turn aperture when the thumb turn actuator is located at a second vertical position in response to the assembly being configured for use in the second configuration.

11. The combination door latch and deadbolt assembly of claim 10, further comprising:

a thumb turn aperture cover plate that covers the thumb turn aperture and including an aperture through which the thumb turn actuator extends, and wherein the thumb turn aperture cover plate is configured to be coupled to the interior escutcheon in a first position when the assembly is in the first configuration and a second position when the assembly is in the second configuration.

12. The combination door latch and deadbolt assembly of claim 10, wherein the thumb turn aperture cover plate is rotated 180 degrees to change the thumb turn aperture cover plate between the first position and the second position.

13. A combination door latch and deadbolt assembly for use with a door having a deadbolt aperture and a latchbolt aperture that extend through the door, the latchbolt aperture spaced from the deadbolt aperture by a vertical distance, the assembly comprising:

a deadbolt assembly including a deadbolt movable between an extended position and a retracted position;

a latchbolt assembly including a latchbolt movable between an extended position and a retracted position;

an interior assembly including an actuator manually movable from a first position to a second position to move the latchbolt from the extended position to the refracted position;

a thumb turn actuator manually operable to move the deadbolt between the retracted position and the extended position;

an interior escutcheon including an elongated thumb turn aperture for the thumb turn actuator, the combination door latch and deadbolt assembly having first and second configurations, the first configuration being used when the door has the latchbolt aperture spaced from the deadbolt aperture by a first vertical distance, and the second configuration being used when the door has the latchbolt aperture spaced from the deadbolt aperture by a second vertical distance less than the first vertical distance, and wherein the elongated thumb turn aperture has a length sufficient to permit the thumb turn actuator to extend through the thumb turn aperture when the thumb turn actuator is located at a first vertical position in response to the assembly being configured for use in the first configuration and to permit the thumb turn actuator to extend through the thumb turn aperture when the thumb turn actuator is located at a second vertical position in response to the assembly being configured for use in the second configuration.

14. The combination door latch and deadbolt assembly of claim 13, wherein the interior escutcheon includes an interior actuator aperture for the actuator of the interior assembly.

15. The combination door latch and deadbolt assembly of claim 13, further comprising:

a thumb turn aperture cover plate that covers the thumb turn aperture and including an aperture through which the thumb turn actuator extends, and wherein the thumb turn aperture cover plate is configured to be coupled to the interior escutcheon in one of a first position when the assembly is configured for use in the first configuration and a second position when the assembly is configured for use in the second configuration.

16. The combination door latch and deadbolt assembly of claim 15, wherein the thumb turn aperture cover plate is rotated 180 degrees to change the thumb turn aperture cover plate between the first position and the second position.

17. A combination door latch and deadbolt assembly for use with a door having a deadbolt aperture and a latchbolt aperture that extend through the door, the latchbolt aperture spaced from the deadbolt aperture by a vertical distance, the assembly comprising:

a deadbolt assembly including a deadbolt movable between an extended position and a retracted position;

a latchbolt assembly including a latchbolt movable between an extended position and a retracted position;

an interior actuator manually movable from a first position to a second position to move the latchbolt from the extended position to the retracted position;

an interconnect slide movable vertically to move the deadbolt from the extended position to the retracted position in response to movement of the interior actuator from the first position to the second position; and a base plate configured to be coupled to the door and the interconnect slide coupled to the base plate such that the base plate guides vertical movement of the interconnect slide;

the combination door latch and deadbolt assembly having first and second configurations, the first configuration being used when the door has the latchbolt aperture spaced from the deadbolt aperture by a first vertical distance, and the second configuration being used when the door has the latchbolt aperture spaced from the deadbolt aperture by a second vertical distance less than the first vertical distance, wherein the interior actuator is in a first fixed position relative to the base plate when the assembly is in the first configuration, and wherein the interior actuator is in a second fixed position relative to the base plate vertically spaced from the first fixed position when the assembly is in the second configuration.

18. The combination door latch and deadbolt assembly of claim 17, further comprising, a deadbolt actuator plate coupled to the base plate;

a driver that extends through the deadbolt actuator plate and the driver configured to rotate to move the deadbolt between the extended position and the retracted position, and wherein the deadbolt actuator plate is coupled to the base plate such that the deadbolt actuator plate is in the same position relative to the base plate when the assembly is in the first configuration and the second configuration.

19. The combination door latch and deadbolt assembly of claim 17, further comprising, a deadbolt actuator plate coupled to the base plate;

a driver that extends through the deadbolt actuator plate and the driver configured to rotate to move the deadbolt between the extended position and the retracted position, and wherein the base plate is made from a first material, and wherein the deadbolt actuator plate is made from a second material.

20. The combination door latch and deadbolt assembly of claim 17, further comprising a latchbolt actuator plate coupled to the interior actuator, wherein the interior actuator is movable with respect to the base plate with the latchbolt actuator plate between the first fixed position and the second fixed position, and wherein the latchbolt actuator plate is directly coupled to the base plate.

21. The combination door latch and deadbolt assembly of claim 20, wherein the latchbolt actuator plate includes a projection, wherein the base plate includes an upper recess and a lower recess, wherein the projection is received within the upper recess when the latchbolt actuator plate is in the second fixed position, and wherein the projection is received within the lower recess when the latchbolt actuator plate is in the first fixed position.

22. The combination door latch and deadbolt assembly of claim 17, further comprising, an interconnect slide cam member coupled to the interior actuator and configured to rotate in response to movement of the interior actuator from the first position to the second position of the actuator, wherein the interconnect slide cam member engages the interconnect slide to move the interconnect slide vertically when the assembly is in the first configuration and the second configuration, and wherein the interconnect slide cam member is coupled to the interior actuator for movement with the interior actuator between the second fixed position and the first fixed position.

23. The combination door latch and deadbolt assembly of claim 17, wherein the base plate includes a base, a first side wall that extends from the base, and a second side wall that extends from the base, wherein the interconnect slide is coupled to the base plate between the first side wall and the second side wall such that the interconnect slide slides with respect to the base plate and the first side wall and the second side wall of the base plate guide vertical movement of the interconnect slide.

* * * * *